United States Patent [19]

Narlow et al.

[11] 4,318,090

[45] Mar. 2, 1982

[54] APPARATUS FOR DEACTIVATING A SURVEILLANCE TAG

[75] Inventors: Douglas A. Narlow, Coral Springs; Eugene Stevens, Pembroke Pines, both of Fla.

[73] Assignee: Sensormatic Electronics Corporation, Deerfield Beach, Fla.

[21] Appl. No.: 201,050

[22] Filed: Oct. 27, 1980

[51] Int. Cl.[3] ..... G08B 13/24

[52] U.S. Cl. ..... 340/572

[58] Field of Search ..... 340/572; 343/6.5 SS, 343/6.8 R

[56] References Cited

U.S. PATENT DOCUMENTS

| | | | |
|---|---|---|---|
| 3,754,226 | 8/1973 | Ferron | 340/572 |
| 3,781,661 | 12/1973 | Triklis | 340/572 |
| 4,021,705 | 5/1977 | Lichtblau | 340/572 |
| 4,063,229 | 12/1977 | Welsh et al. | 340/280 |
| 4,158,434 | 6/1979 | Peterson | 340/572 |

*Primary Examiner*—Glen R. Swann, III

*Attorney, Agent, or Firm*—Hopgood, Calimafde, Kalil, Blaustein & Judlowe

[57] ABSTRACT

A pulse source powers a wand-like probe with spaced contacts that is arranged to be applied to and drawn along the surface of a surveillance tag that contains a diode semiconductor with exposed terminals. When the probe contacts engage the diode terminals, current is passed through the diode sufficient to destroy its unidirectional conducting characteristics and thereby deactivate the tag. A cut-out circuit is included to prevent the passage of excessive current through the diode or damaging short-circuiting of the power amplifier output.

12 Claims, 13 Drawing Figures

Fig. 9.
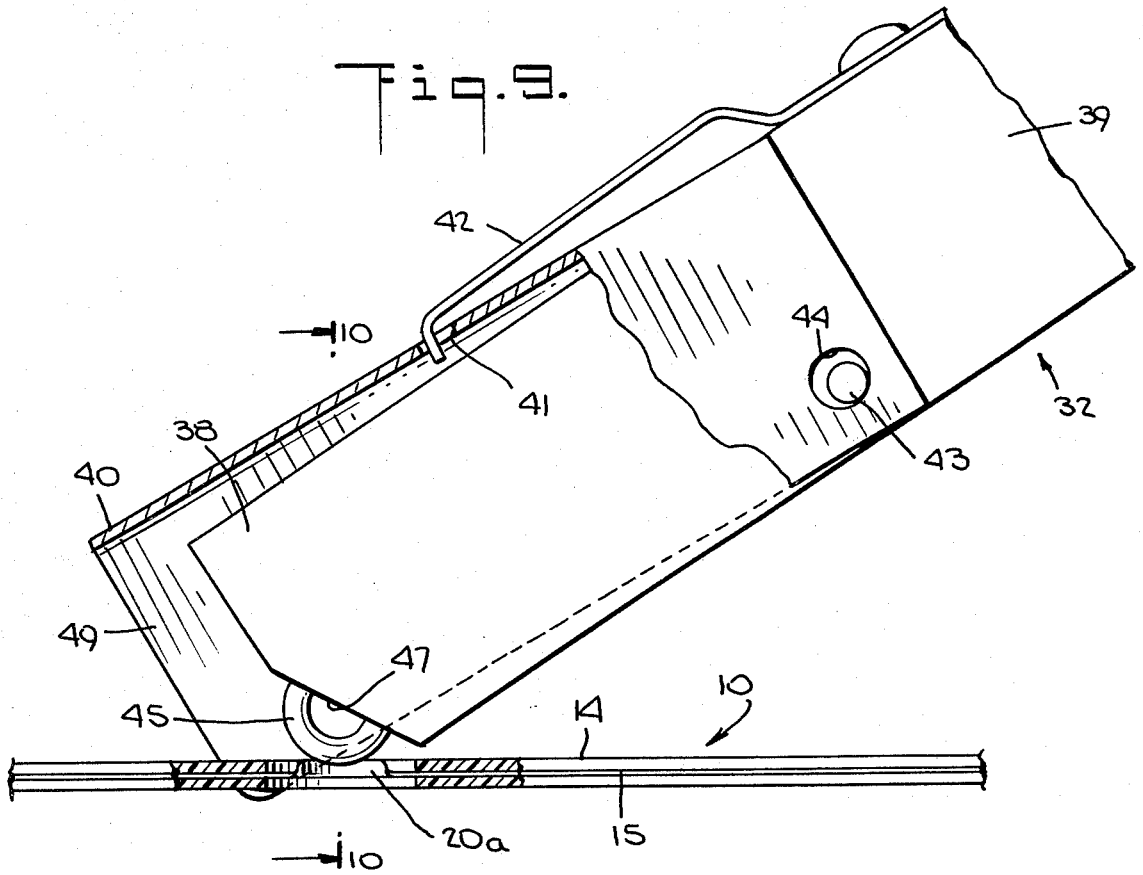
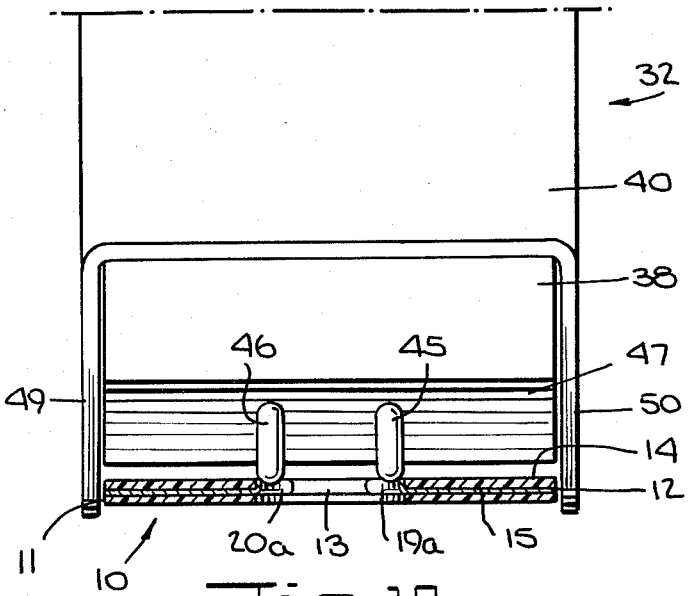
Fig. 10.

APPARATUS FOR DEACTIVATING A SURVEILLANCE TAG

BACKGROUND OF THE INVENTION

The present invention relates to surveillance systems and apparatus used to prevent shoplifting and similar unauthorized removal of articles from a controlled area. More particularly, it relates to apparatus for deactivating a surveillance tag for authorized removal from the area.

In U.S. Pat. No. 4,063,229, issued on Dec. 13, 1977, to John Welsh and Richard N. Vaughan for "Article Surveillance", and assigned to the same assignee as the present application, there is described a system wherein sensor-emitter labels or tags containing a semiconductor diode or the like are applied to articles for the purpose of surveillance. For deactivating such tags, said patent describes various devices including, among others, radio frequency generators for burning out the diode. However, such generators are disclosed as being of quite high power and are coupled inductively to the tags by way of an r.f. field. The use of such radiated fields give rise to various problems including the unknown risks to the human operators.

Said patent also describes the construction of special tags containing layers of ferrite material that can be magnetized or demagnetized by a suitable magnetic field for altering the operating characteristic of the tag and thereby deactivating the same. But the latter method complicates the tag construction and increases the cost significantly of the one component that is desired to be expendable.

Thus, it is an object of the present invention to overcome said disadvantages that are inherent in the previously known surveillance systems while hardly increasing the cost, if at all, of the expendable tags utilized. It is a further object to provide a completely safe deactivating system employing very low voltages and miniscule power, yet capable of deactivating a tag whose active element is a semiconductor diode.

SUMMARY OF THE INVENTION

In accordance with the present invention there is provided apparatus for deactivating a surveillance tag, the detection of which by an interrogation station is dependent upon the condition of a semiconductor diode contained in said tag which diode is connected conductively to a first pair of contacts exposed adjacent at least one surface of said tag, said apparatus comprising a probe constructed to be brought into engagement with said one surface and moved relative thereto, said probe including a second pair of contacts that ride along said one surface during said movement of said probe so as to engage conductively said first pair of contacts, and means coupled to said second pair of contacts for furnishing thereto alternating current sufficient to deteriorate said diode during the interval of said conductive engagement such that said tag is no longer detectable by said interrogation station.

BRIEF DESCRIPTION OF THE DRAWING

The invention will be better understood after reading the following detailed description of the presently preferred embodiment thereof with reference to the appended drawings in which:

FIG. 9 is an enlarged fragmentary side view, with portions broken away, of the contact carrying end of the probe of FIG. 6 showing the latter in operative engagement with the tag of FIG. 1;

FIG. 10 is a sectional view taken along the line 10—10 in FIG. 9;

DESCRIPTION OF THE PREFERRED EMBODIMENT

Figure 1:
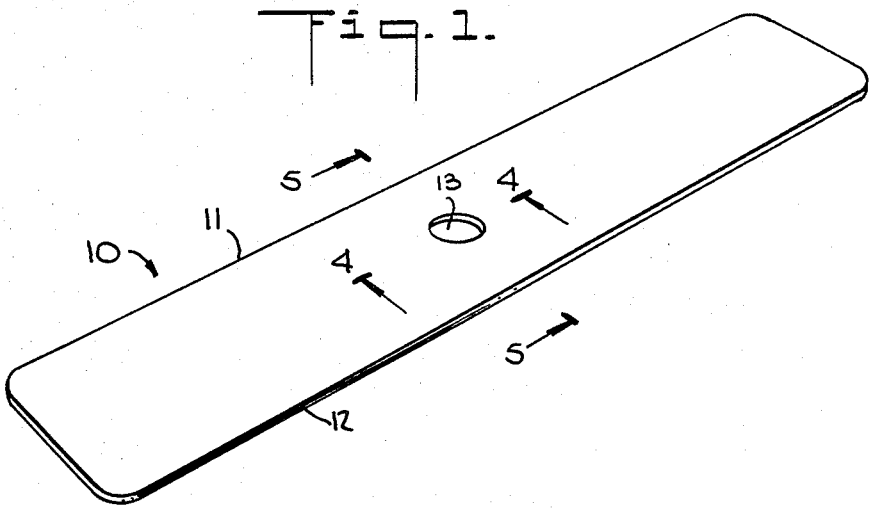
FIG. 1 is a perspective illustration of a surveillance tag of the type that can be deactivated by apparatus described hereinafter.
Figure 2:
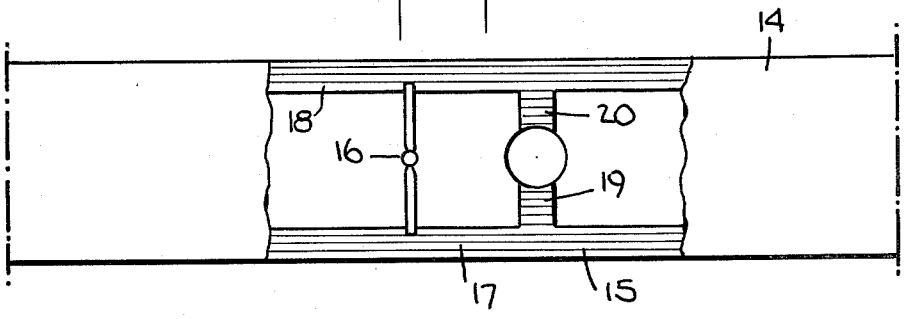
FIG. 2 is a fragmentary plan view with portions broken away to reveal the interior of the tag shown in FIG. 1.
Figure 4:
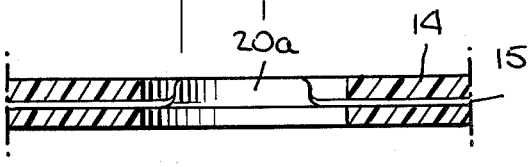
FIG. 4 is a sectional view taken along the line 4—4 in FIG. 1.
Figure 5:
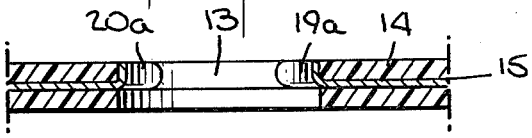
FIG. 5 is a sectional view taken along the line 5—5 in FIG. 1.

Reference now should be had to the drawings wherein the same reference numerals are used throughout to designate the same or similar parts. In FIG. 1 is shown a tag, designated generally by the reference numeral 10, of thin, narrow and elongated construction with parallel side edges 11 and 12 and a through aperture 13, the significance of which will be described hereinafter. The surveillance tag 10 is of laminated construction having an operative layer containing a semiconductor diode and interconnected foil antenna elements sandwiched between insulating layers of paper or similar material. This can be seen more clearly in FIG. 2 wherein the upper insulating layer 14 has been broken away to reveal the intermediate layer 15 with its semiconductor diode 16 joined to conductive side strips 17 and 18, each with a respective lateral segment 19 and 20. As seen in FIGS. 4 and 5 the lateral segments 19 and 20 extend into the aperture 13 and turn upwardly to form contacts hugging the side walls of the aperture at 19*a* and 20*a*.

Figure 3:
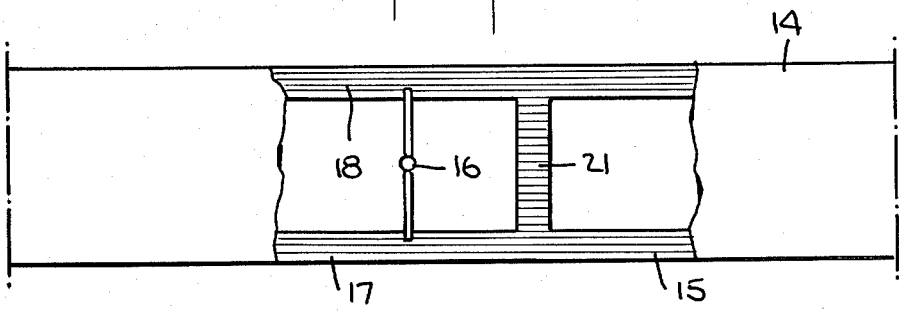
FIG. 3 is a view similar to FIG. 2 but showing the interior of the tag at an intermediate stage in its fabrication.

In order to understand the method of forming the contacts 19*a* and 20*a*, reference should be had to FIG. 3 showing an intermediate stage in the construction of the tag. As seen therein the foil of layer 15 is provided with a continuous bridge 21 joining the side strips 17 and 18. When the aperture 13 is introduced by means of a punch moving in the upward direction as viewed in FIGS. 4 and 5, portions of the bridge 21 are "wiped" in the upward direction against the side wall of the aperture being formed so as to produce the contacts 19*a* and 20*a*.

As will be apparent from the ensuing discussion, the details and construction of the antenna elements of the tag have no bearing on the subject invention. Similarly, the diode 16 may take various forms so long as it is susceptible of being deteriorated by passing excessive current therethrough.

Figure 6:
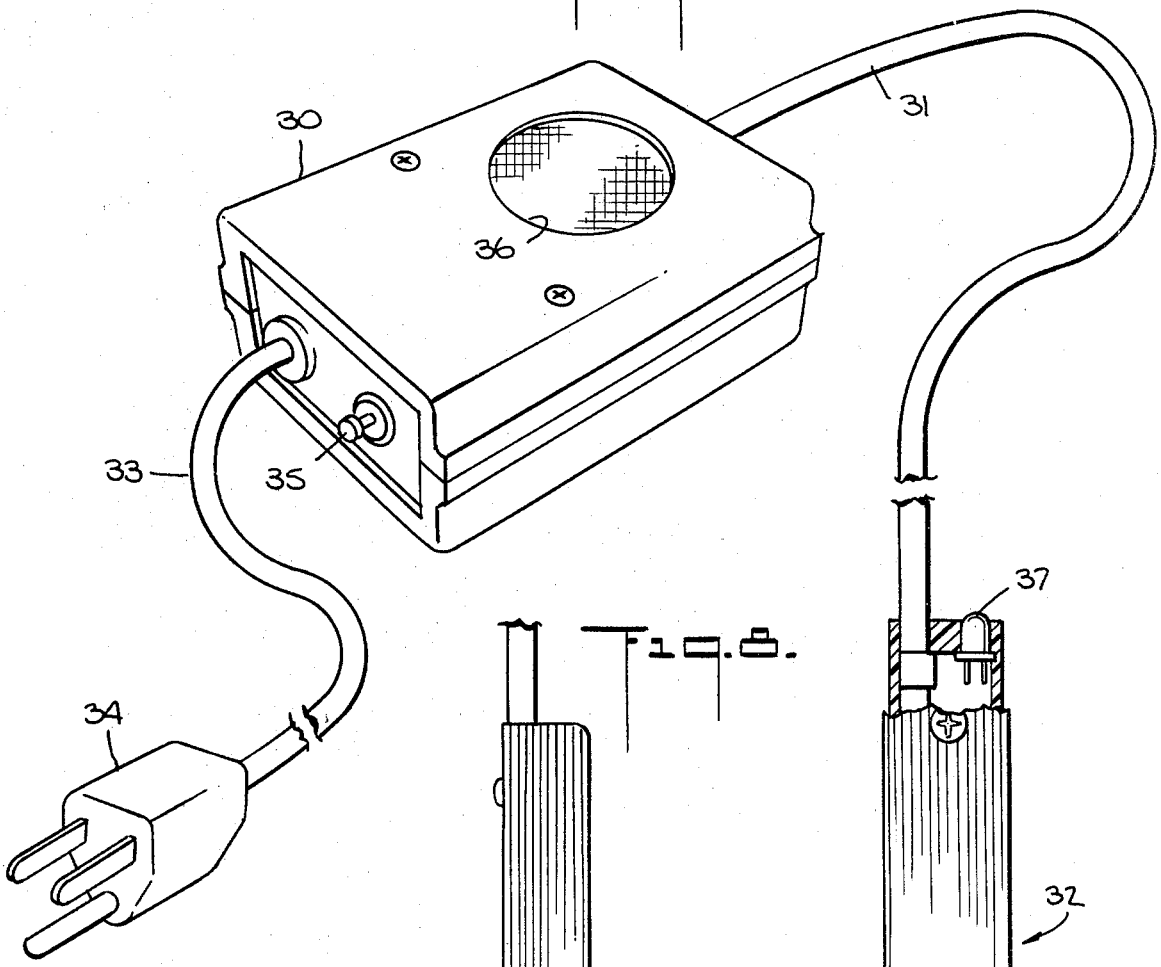
FIG. 6 is a plan view of the deactivation apparatus embodying the present invention consisting of a control unit and a cable connected probe.

Reference may now be had to FIG. 6 wherein there is illustrated the deactivation apparatus embodying the present invention. It consists of a control unit 30 coupled by a flexible cable 31 to a wand-like probe 32. The control unit 30 is provided with a power cord 33 terminating in a plug 34. A push type power switch 35 is also provided mounted conveniently on the control unit 30. The reference numeral 36 designates an opening in the case of the control unit 30 which opening is covered by an acoustic grill behind which is mounted an electro-acoustic transducer for producing an audible signal as explained hereinafter.

Figure 8:
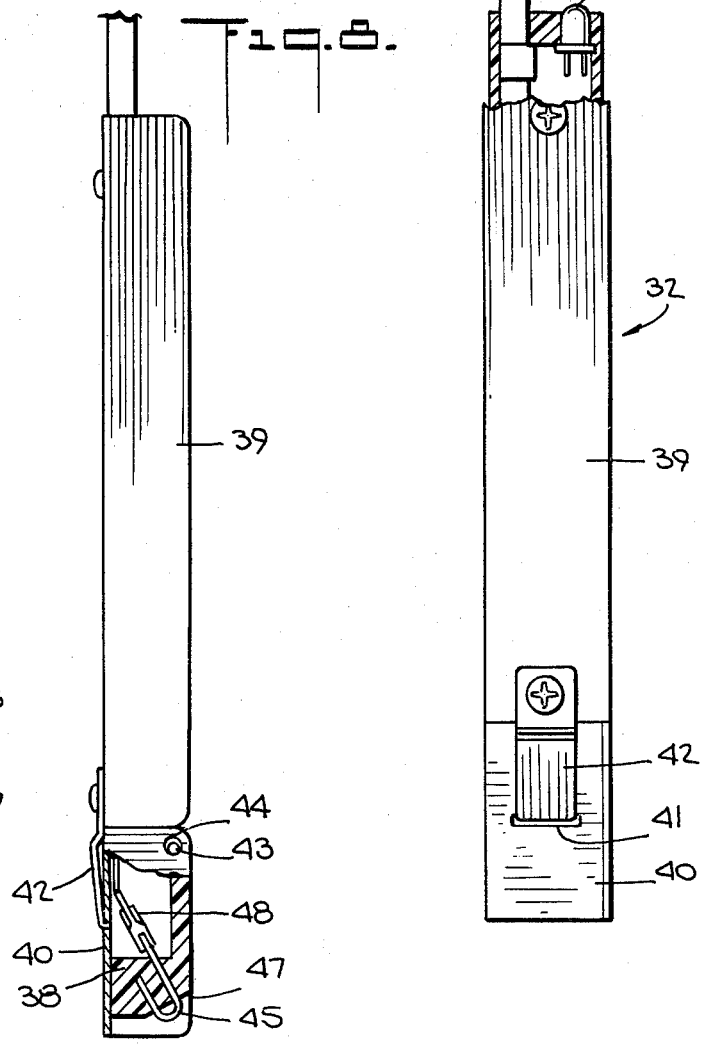
FIG. 8 is a side elevational view of the probe in FIG. 6, with portions broken away to show further details of its tag engaging contacts.
Figure 7:
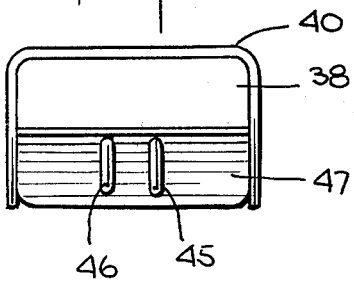
FIG. 7 is an end view of the probe in FIG. 6, showing the contacts that engage the tag contacts.

The probe 32 houses a signal lamp 37 at one end alongside the entry for the connecting cable 31. As best seen in FIGS. 7 and 8, the probe 32 consists of a plastic body 38 extending throughout its length over which is fastened a metal U-shaped cover 39 in fixed position and a similar metal extension 40 that is movably mounted. The extension 40 is attached to the body 38 by means of the engagement in slot 41 (FIGS. 6 and 9) of the spring clip 42 and of pin 43 projecting through the enlarged aperture 44. The clearance between the aperture 44 and the pin 43 permits the cover section 40 to articulate.

Two U-shaped wire electrodes 45 and 46, best seen in FIGS. 7 and 8, project from the bevelled surface 47 at the end of the body 38 remote from the end containing the signal lamp 37. The contacts 45 and 46 are connected to leads such as that shown at 48 through the cable 31 to the control circuit that will be described below. However, before considering the control circuit it would be helpful to understand the cooperation between the probe 32 and the tag 10 when the probe 32 is employed to deactivate such tag. Such cooperation is best illustrated in FIGS. 9 and 10 to which attention should now be directed.

The probe 32 will be held by the operator in much the same manner as a pencil and will be applied to one end of the tag 10 such that the parallel planar side walls 49 and 50 of the articulable cover member 40 engage, respectively, the opposite sides 11 and 12 of the tag 10. As the probe 32 is pressed down upon the upper surface 14 of the tag 10, with the latter affixed to the surface of an article (not shown), the cover 40 will be deflected from the position shown in FIG. 8 to that shown in FIG. 9 permitting the contacts 45 and 46 to engage the upper surface 14 of the tag. Thereupon, the operator draws the probe with its contacts 45 and 46 along the surface 14 of the tag 10 with the side walls 49 and 50 of cover member 40 guiding the probe therealong. This serves to position accurately the contacts 45 and 46 along a course parallel to the side edges 11 and 12 of the tag 10.

At some point in the traverse of the probe over the surface of the tag, the contacts 45 and 46 will approach and pass across the aperture 13. The spacing between contacts 45 and 46 (best seen in FIG. 10) is chosen relative to the diameter of aperture 13 such that contacts 45 and 46 will penetrate slightly aperture 13 as it reaches the position shown in FIG. 9. This insures direct conductive engagement between contacts 45 and 46 and contacts 19*a* and 20*a*, respectively.

In an actual embodiment of the subject invention that has been found to function satisfactorily, the specified nominal diameter of aperture 13 is 0.250 inch, although in practice said aperture is fractionally smaller, and the contacts 45 and 46 are formed from 0.041 inch diameter wire spaced apart, centerline to centerline, 0.210 inch.

Figure 11:
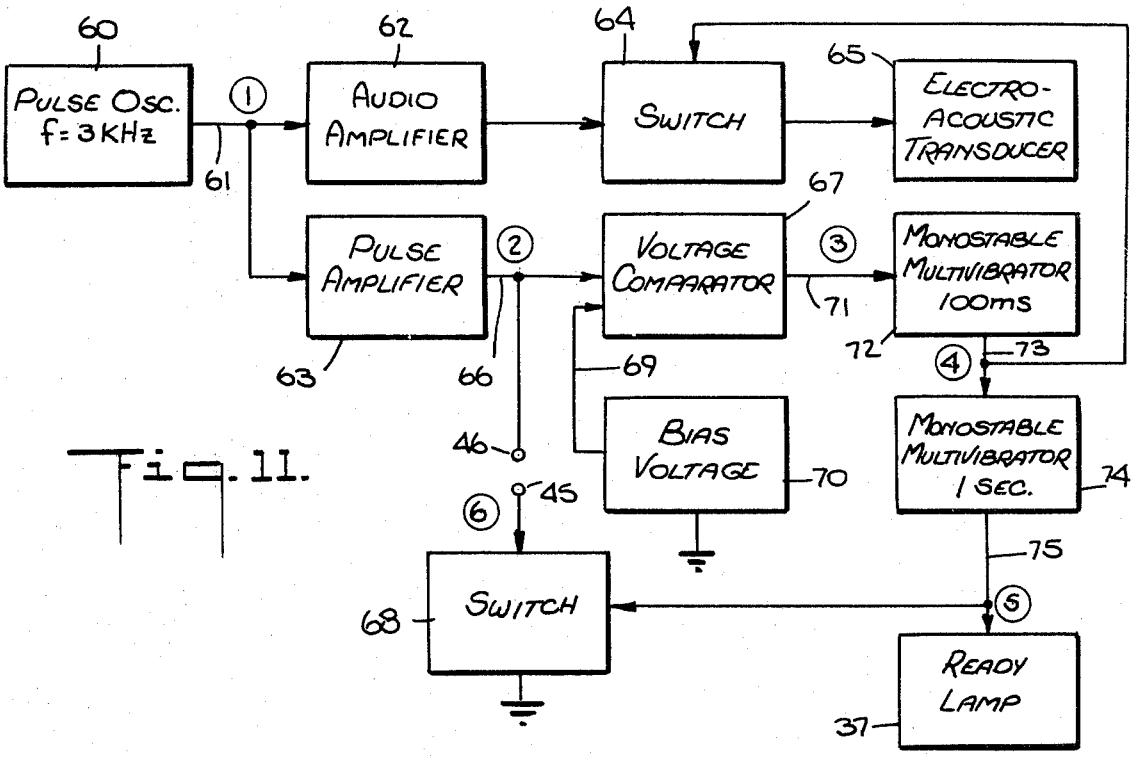
FIG. 11 is an electrical block diagram of the circuit incorporated in FIG. 6.
Figure 12:
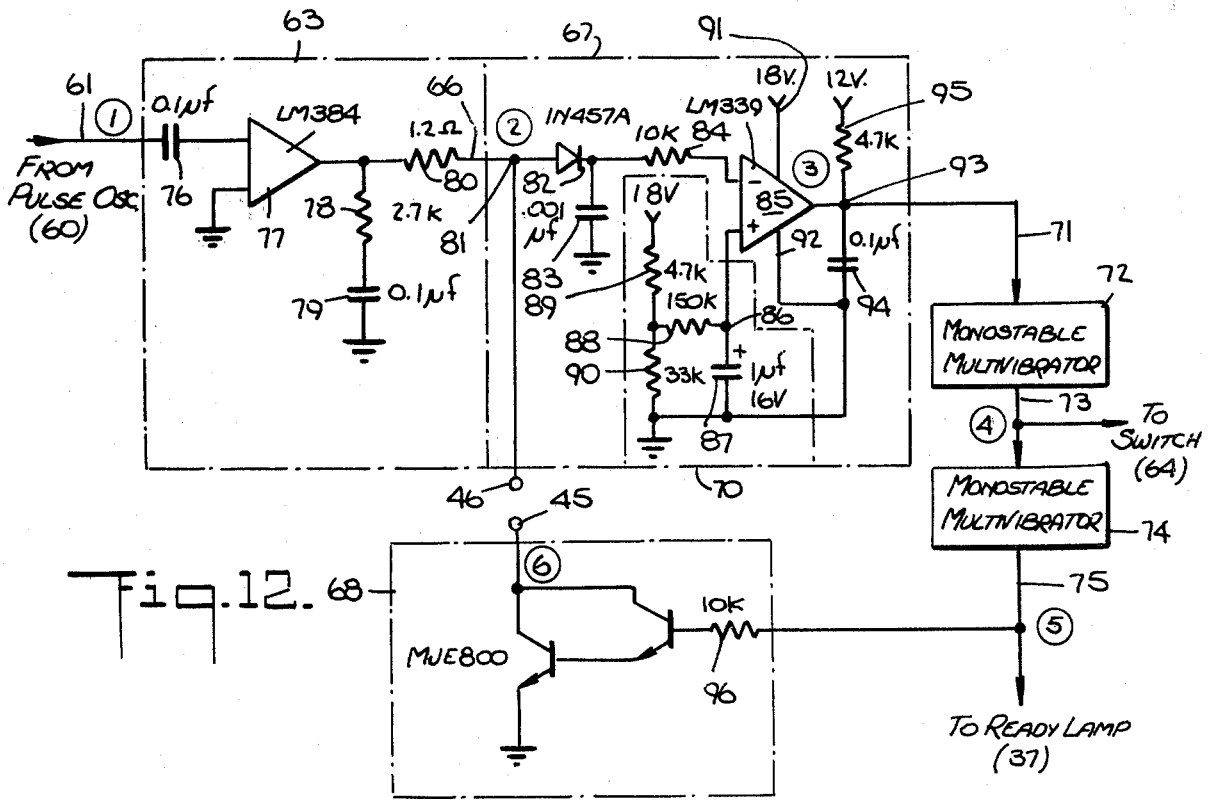
FIG. 12 is an electrical schematic diagram of a portion of the circuit of FIG. 11 showing certain details thereof.
Figure 13:
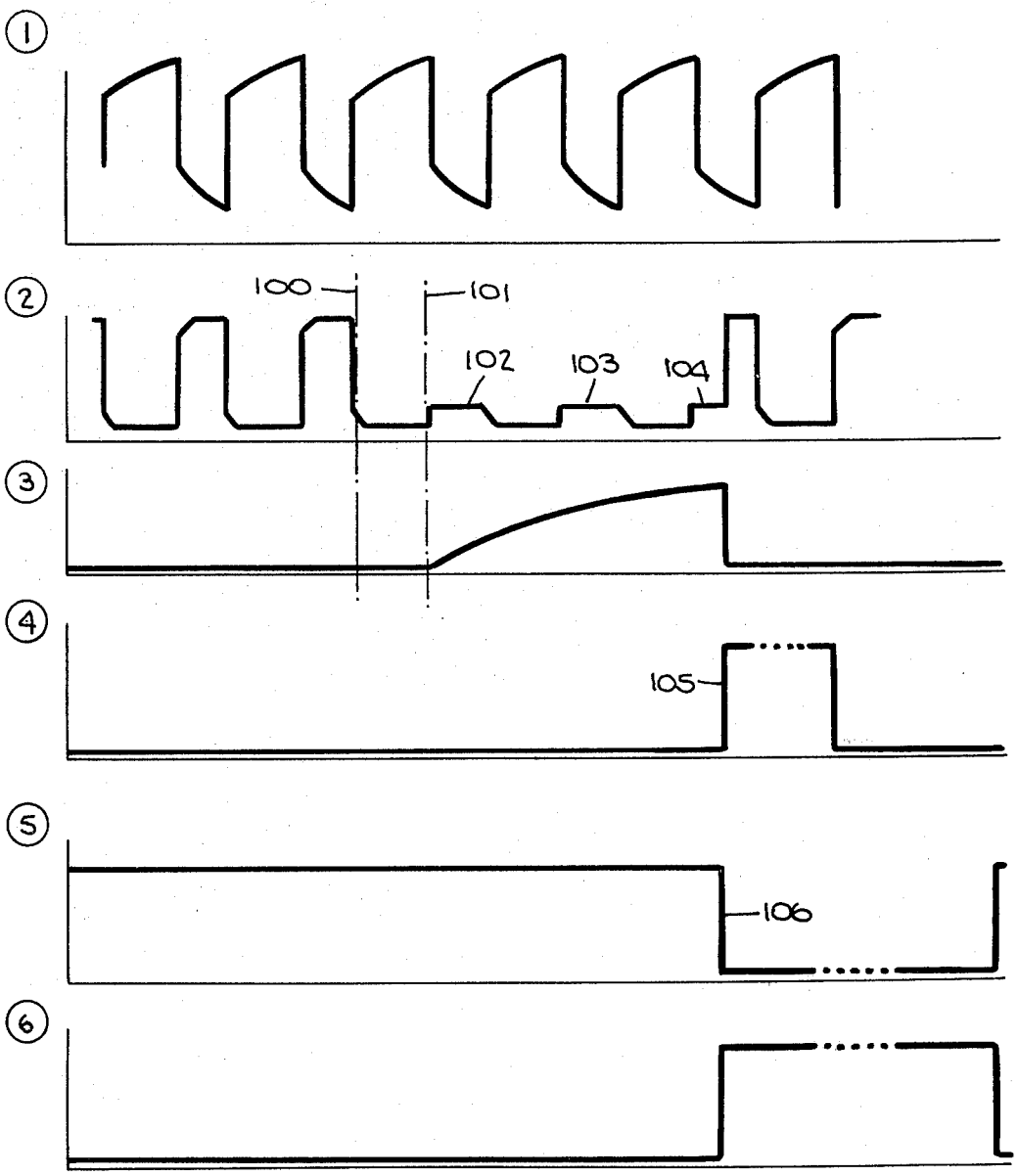
FIG. 13 is a series of pulse diagrams showing the waveforms at various points in the circuits of FIGS. 11 and 12.

Attention should now be directed to FIGS. 11, 12 and 13 illustrating the electronic circuit incorporated in the control unit 30. Referring first to FIG. 11, a pulse oscillator 60 operating at a pulse frequency of 3 KHz furnishes an output over lead 61 to both an audio amplifier 62 and a pulse amplifier 63. The output from audio amplifier 62 is fed through a switch 64 to an electro-acoustic transducer 65. The electro-acoustic transducer is mounted within the control unit 30 (see FIG. 6) behind the grill under the opening 36. The output from the pulse amplifier 63 is fed over lead 66 to one input of a voltage comparator 67 and to the contact 46 in the probe 32. The other contact in the probe, contact 45, is connected through a switch 68 to ground. The second input to the voltage comparator 67 is obtained over lead 69 from a bias voltage source 70, the other side of which is connected to ground. The output from the voltage comparator 67 is connected over lead 71 to the input of a monostable multivibrator 72 having a delay of about 100 milliseconds. The output from the multivibrator 72 is fed over lead 73 to both the control input of switch 64 and to the input to a second monostable multivibrator 74. The latter has a delay period of one second and its output is connected over lead 75 to both the ready lamp 37 and the control input to switch 68.

Referring now to FIG. 12, there is illustrated the detailed circuit incorporated in pulse amplifier 63, voltage comparator 67, bias voltage source 70 and switch 68. Thus, the output from pulse oscillator 60 is furnished over lead 61 through a coupling capacitor 76 to one input of an audio power amplifier 77, the other input of which is connected to ground. The output from audio amplifier 77 is connected to ground through a resistor 78 in series with a capacitor 79. In addition, said output is connected through a small resistor 80 to the lead 66 which divides at the junction 81, connecting directly to contact 46 and to one terminal of a diode 82. The other terminal of the diode 82 is connected to ground through a capacitor 83 and through a resistor 84 to one terminal of the comparator 85. As shown, the last connection is made to the negative input of the comparator 85 such that the output of said comparator is inverted with respect to the voltage furnished to said input. The other input of comparator 85 is connected to a junction 86 between a capacitor 87 and a resistor 88. The opposite end of capacitor 87 is connected to ground while the opposite end of resistor 88 is connected to the junction between a resistor 89 and a resistor 90. The free end of resistor 90 is connected to ground while the free end of resistor 89 is connected to the positive terminal of an 18 volt DC source. The comparator 85 is powered by the connection 91 to the 18 volt DC source and the connection 92 to ground.

The output from comparator 85 is connected to a junction 93 between a capacitor 94 joined to ground and a resistor 95 connected to the positive terminal of a 12 volt DC source. Junction 93 constitutes the output terminal from the voltage comparator 67 and it is connected through lead 71 to the monostable multivibrator 72.

The switch 68 consists of a Darlington amplifier circuit connected between the contact 45 and ground and having its control input connected through resistor 96 to the output lead 75 leading from the multivibrator 74.

In a preferred embodiment of the subject circuit the resistors and capacitors have the values indicated on the drawing while the power amplifier 77 may be a National Semiconductor type LM 384 component and the comparator 85 may constitute one section of a National Semiconductor quad comparator type LM 339. The Darlington amplifier in switch 68 may be a Motorola type MJE800 while the diode 82 may be a type 1N457A.

The operation of the circuit described with reference to FIGS. 11 and 12 can now be explained with further reference to the wave shape diagrams contained in FIG. 13. The output from the pulse oscillator 60 over lead 61 will appear somewhat as shown on line (1) of FIG. 13. Assuming that the contacts 45 and 46 have not yet engaged the contacts on a tag, there will exist an open circuit or infinite impedance between contacts 45 and 46, and the voltage appearing on lead 66 at the output of pulse amplifier 63 will appear as shown on line (2) of FIG. 13 to the left of the broken line 100. The pulses on lead 66 during this period of operation will have an amplitude of about 15 volts. During this inactive period the pulses appearing on lead 66 at the input to the voltage comparator 67 will cause a charge to accumulate on capacitor 83 so as to maintain the voltage at the negative input to voltage comparator 85 close to the peak level, or 15 volt level, of the pulse amplifier output. This causes the output from the voltage comparator on lead 71 to approach zero or minimum value. The output of monostable multivibrator 72 on lead 73 will be low as shown in line (4) of FIG. 13 while the output of multivibrator 74 on lead 75 will be high as shown on line (5) of FIG. 13. Consequently, with the high signal or voltage appearing on lead 75, the ready lamp 37 will be illuminated to signify that the device is ready to scan a tag and deactivate the same while switch 68 will be in a condition to conduct current.

Assuming that the contacts 45 and 46 of the probe are brought into engagement with the contacts on a tag during the interval bounded by the broken lines 100 and 101 in FIG. 13, upon the very next occurrence of a positive going pulse on lead 66, current will be drawn through resistor 80 and fed through the diode of the tag now bridging contacts 45 and 46 and through the switch 68 to ground. This condition is reflected by a drop in voltage on the lead 66 and is shown by the reduced amplitude pulse 102 in line (2) of FIG. 13.

During a sequence of several pulses, current continues to flow via the contacts 45 and 46 through the diode to be deteriorated. This maintains the truncated pulse 103 and 104 seen on line (2) of FIG. 13. In the absence of pulse voltage to maintain the charge on capacitor 83 the charge on the latter immediately commences to leak off through resistor 84 and the internal impedance of the comparator 85. After inversion within the comparator the voltage at its output on lead 71 will appear as shown on line (3) in FIG. 13. Bias voltage source 70 sets a clipping level within the comparator 85 to remove the 3 KHz voltage fluctuations appearing across capacitor 83 during the standby condition of the probe. At some point in time the voltage on lead 71 will reach the triggering level of monostable multivibrator 72 causing it to shift to its active state. The output of multivibrator 72 is shown on line (4) of FIG. 13 with the leading edge of its output pulse represented by the numeral 105. Said multivibrator is arranged to have a time delay of approximately 100 milliseconds during which it causes the switch 64 to "close" feeding signals from audio amplifier 62 to the electro-acoustic transducer 65 which produces an audible tone. Said tone will signal the operator that a tag has been engaged satisfactorily by the probe. Coincident with the switching of multivibrator 72 represented by the leading edge 105 in line (4) of FIG. 13 there occurs the switching of multivibrator 74 such that its output on lead 75 drops to its low condition represented by trailing edge 106 in line (5) of FIG. 13. The low condition of multivibrator 74 is maintained for approximately one second by its own internal time constants. During this low condition of multivibrator 74 the switch 68 is "open circuited" so as to interrupt any further flow of current through a diode that might be engaged by contacts 45 and 46. It is assumed that within the one second ON time of multivibrator 74 the operator will have removed the probe from the tag such that subsequent enabling of switch 68 will not cause additional current to flow through said diode.

The time constant provided by capacitor 83 resistor 84 and the internal impedance of the comparator 85 should be selected such that the time interval between the point 101 in FIG. 13 and the appearance of the leading edge 105 of the output from monostable multivibrator 72 is just sufficient to furnish enough energy to the particular diodes employed in the tags 10 to destroy the assymetric characteristic of the diode converting it into an equivalent resistor that is incapable of providing a signal for triggering the surveillance equipment. It has been found that excessive current through the diode will cause the development of assymetry in its conductive properties sufficient, albeit weakly, to trigger the surveillance equipment with which it is designed to operate. Hence, the time constant mentioned above should be chosen so as to interrupt the flow of current to the diode before certain rectifying properties are re-developed.

Interruption of current flow through contacts 45 and 46 also serves as a safety means in case the probe is inadvertently placed in contact with a metal surface shorting the contacts. In the absence of some means to interrupt the flow of current through said contacts the pulse amplifier 63 could be damaged.

It will be understood that ready lamp 37 may comprise a suitable power amplifier circuit for receiving the control output from multivibrator 74 and furnishing power to a signal lamp.

While not illustrated, it will be understood also that a suitable power supply is incorporated in the control unit 30 furnished with line voltage over power cable 33 and controlled by switch 35 for furnishing the 12 volt and 18 volt DC supply to the various circuit components.

Having described the subject invention with reference to the presently preferred embodiment thereof it will be understood by those skilled in the subject art that various changes may be made in the construction of the apparatus without departing from the true spirit of the invention as defined in the appended claims.

What is claimed is:

1. Apparatus for deactivating a surveillance tag, the detection of which by an interrogation station is dependent upon the condition of a semiconductor diode contained in said tag which diode is connected conductively to a first pair of contacts exposed adjacent at least one surface of said tag, said apparatus comprising a probe constructed to be brought into engagement with said one surface and moved relative thereto, said probe including a second pair of contacts that ride along said one surface during said movement of said probe so as to engage conductively said first pair of contacts, and means coupled to said second pair of contacts for furnishing thereto alternating current sufficient to deteriorate said diode during the interval of said conductive engagement such that said tag is no longer detectable by said interrogation station.

2. Apparatus according to claim 1, wherein said means comprises means responsive to a given change in potential drop across said second pair of contacts resulting from said engagement with said first pair of contacts for interrupting the flow of current through said second pair of contacts.

3. Apparatus according to claim 2, wherein said means responsive to a given change in potential drop across said second pair of contacts is also constructed and arranged upon such change in potential drop to provide a signal to an operator that a tag has been deactivated.

4. Apparatus according to claim 1, wherein said means comprises means responsive to a given change in potential drop across said second pair of contacts resulting from said engagement with said first pair of contacts for furnishing a signal to an operator that a tag has been deactivated.

5. Apparatus according to claim 1, wherein said means comprises an oscillatory source operating at an audio frequency having an output coupled to said second pair of contacts for feeding a train of pulses thereto.

6. Apparatus according to claim 5, wherein said audio frequency is about 3 KHz.

7. Apparatus according to claim 5, wherein said source output is coupled to an electro-acoustic transducer for producing an audible signal responsive to a given decrease in potential drop across said second pair of contacts resulting from engagement with said first pair of contacts to provide a signal to an operator that a tag has been deactivated.

8. Apparatus according to claim 5, wherein said source output is coupled through a given impedance to both said second pair of contacts and to a voltage comparator, and said voltage comparator includes an output coupled to a circuit interrupter that is coupled to said second pair of contacts for interrupting the flow of current through the latter whenever said voltage comparator senses a predetermined drop in the voltage applied to said second set of contacts.

9. Apparatus according to claim 8, further comprising means coupled to said circuit interrupter for resetting the latter a predetermined interval after said second pair of contacts has been disengaged from said first pair of contacts to prepare said apparatus for another deactivating sequence.

10. Apparatus according to claim 1, wherein said second pair of contacts are mounted at the end of a wand-like structure, projecting from an end face of the latter, and spaced apart a predetermined distance from each other, said second pair of contacts being configured to be drawn with a gliding contact across the surface of said tag when said wand-like structure is held at an angle to said tag surface and moved relatively thereto, and said probe includes means for guiding the positioning of said probe relative to said tag as the former is drawn across the latter.

11. Apparatus according to claim 10, wherein said tag is narrow, thin and elongated with parallel sides, said first pair of contacts are disposed at a given distance from said sides, and said means for guiding the probe comprises a pair of parallel spaced apart planar members for engaging, respectively, opposite sides of said tag when said second pair of contacts engage a surface of said tag that extends between said sides.

12. Apparatus according to claim 11, wherein said second pair of contacts comprise two U-shaped wire elements with the legs of the "U" mounted in said wand-like structure and the base of the "U" projecting to be engaged with the surface of said tag.

* * * * *